US005713088A

United States Patent [19]

Wagner et al.

[11] Patent Number: 5,713,088

[45] Date of Patent: Feb. 3, 1998

[54] INNERSPRING CONSTRUCTION WITH SPRINGS HAVING FREE TERMINAL CONVOLUTIONS

[75] Inventors: Robert F. Wagner, Medina; Barry William Freeman, Lodi; Paul J. Langer, Bay Village, all of Ohio

[73] Assignee: Ohio Mattress Company Licensing and Components Group, Cleveland, Ohio

[21] Appl. No.: 835,544

[22] Filed: Apr. 8, 1997

Related U.S. Application Data

[63] Continuation of Ser. No. 327,023, Oct. 21, 1994, abandoned.

[51] Int. Cl.[6] ..... A47G 23/053; F16F 3/04

[52] U.S. Cl. ..... 5/256; 5/252; 5/269; 5/716; 267/91; 267/104

[58] Field of Search ..... 5/716

[56] References Cited

U.S. PATENT DOCUMENTS

| | | | |
|---|---|---|---|
| 137,030 | 3/1873 | Roller | 5/475 |
| 184,703 | 11/1876 | DeCamp . | |
| 1,211,267 | 1/1917 | Young | 5/260 |
| 1,337,320 | 4/1920 | Karr . | |
| 1,798,885 | 3/1931 | Karr . | |
| 1,907,324 | 5/1933 | Kirchner . | |
| 1,938,489 | 12/1933 | Karr . | |
| 1,950,770 | 3/1934 | Bayer . | |
| 1,989,302 | 1/1935 | Wilmot | 5/252 |
| 2,054,868 | 9/1936 | Schwartzman . | |
| 2,214,135 | 9/1940 | Hickman . | |
| 2,348,897 | 5/1944 | Gladstone . | |
| 2,480,158 | 8/1949 | Owen | 267/91 |
| 2,562,099 | 7/1951 | Hilton | 5/475 |
| 2,611,910 | 9/1952 | Bell | 267/91 |
| 2,617,124 | 11/1952 | Johnson . | |
| 3,089,154 | 5/1963 | Boyles . | |
| 3,107,367 | 10/1963 | Nachman, Jr. . | |
| 3,533,114 | 10/1970 | Karpen . | |
| 4,122,566 | 10/1978 | Yates . | |
| 4,566,926 | 1/1986 | Stumpf . | |
| 4,578,834 | 4/1986 | Stumpf . | |
| 4,609,186 | 9/1986 | Thoenen . | |
| 4,726,572 | 2/1988 | Flesher et al. | 267/91 |
| 4,781,360 | 11/1988 | Ramsey . | |
| 4,817,924 | 4/1989 | Thoenen . | |
| 4,960,267 | 10/1990 | Scott . | |

FOREIGN PATENT DOCUMENTS

| | | | |
|---|---|---|---|
| 03810582 | 9/1932 | United Kingdom | 5/256 |
| 494428 | 10/1938 | United Kingdom | 5/252 |

*Primary Examiner*—Suzanne Dino
*Assistant Examiner*—Robert G. Santos
*Attorney, Agent, or Firm*—Calfee, Halter & Griswold LLP

[57] ABSTRACT

An innerspring assembly, such as for use in a mattress, comprises a plurality of coil springs defining upper and lower terminal convolutions and body portions therebetween. Adjacent coil springs are attached together at the body portions thereof with the terminal convolutions being unattached to one another, so that the terminal convolution can move independently of one another.

14 Claims, 6 Drawing Sheets

INNERSPRING CONSTRUCTION WITH SPRINGS HAVING FREE TERMINAL CONVOLUTIONS

This application is a continuation of application Ser. No. 08/327,023 filed on Oct. 21, 1994, now abandoned.

FIELD OF THE INVENTION

The present invention relates to a novel innerspring assembly, and particularly, one adapted for use as a matteress.

BACKGROUND OF THE INVENTION

Innerspring assemblies are conventionally made from arrays of vertically-oriented coil springs (i.e., the longitudinal axes of the typical helical springs are perpendicular to the innerspring support surface). The springs are arranged in a generally side-by-side arrangement, usually in parallel columns and parallel rows, to form a support surface. To secure the individual spring coils together and thereby form a unitary innerspring assembly, some form of attachment means is normally employed such as clips, cross-helical springs and the like. Usually adjacent springs are attached together at their terminal convolutions, i.e., the metal turn at the very top and bottom of the springs. See, for example, Bell U.S. Pat. No. 2,611,910, and particularly Flesher et al. U.S. Pat. No. 4,726,572.

Another design for uniting coil springs in an innerspring assembly employs pocketed coil springs, i.e., individual coil springs which are each encased in a "cell" made from fabric or other flexible material. To form an integral innerspring assembly for these pocketed coil springs, the individual flexible covers of the pocketed coil springs are attached to one another by sewing, strings, hot melt adhesives or other means. The springs themselves are, however, typically not interconnected except through this joining of their pockets.

Each of these designs has its own advantages. For example, the pocketed coil design offers a degree of mobility between individual springs, in particular because the terminal convolutions of adjacent coils are not directly secured together. A certain amount of "float" between springs is therefore available. Conventional designs using clipped or otherwise wire-joined spring ends tend to offer superior longevity and ease of manufacture, in part because the use of fabrics is eliminated.

A principal objective of the present invention is to provide a novel innerspring assembly design, particularly for use in an innerspring mattress, which provides a conventional joining of adjacent springs through the use of cross-helical connections, for example, but which also successfully incorporates a degree of freedom or mobility for the springs to achieve a spring "float" or flexibility to the spring ends.

SUMMARY OF THE INVENTION

This and other objectives are accomplished by the present invention which comprises in one of its broadest expressions joining adjacent springs at a turn other than the terminal convolution. For example, adjacent coil springs are joined at the first or second turn inboard (i.e., along the spring axis) from the terminal convolution. This leaves one or two turns outboard of the point of joining which are unattached as between other springs. This free end construction thus has the ability to readily move in response to a load, particularly advantageous if the load is offaxis (such as a load with a lateral component relative to the support surface). A "free-floating" support surface is therefore available through this inventive innerspring assembly, yet the springs themselves can be joined together in a very stable array using conventional manufacturing techniques (e.g., cross-helical connections).

Thus, in accordance with the present invention, a helical spring for use in an innerspring assembly made from a plurality of springs has a compressible body portion comprised of a plurality of coil turns, a terminal convolution at each end of the body portion, and at least one offset segment formed on a coil turn of the body portion. As a practical matter, coil turns on each end of the body portion would have such offset segments, since helical springs are generally manufactured with axial symmetry.

The coil turn(s) of the body portion having the offset segments are spaced from a respective terminal convolution, such as being on the next turn inboard from the terminal convolution, the second turn inboard, etc. The offset segment(s) are adapted for engagement with means for interconnecting a plurality of these springs together in the innerspring assembly. Such an interconnection would be by clips or cross-helical springs, for example.

By so connecting the springs at points inboard from the terminal convolution, the latter and any intermediate turns remain free of the interconnecting means when the springs are in the innerspring assembly. This yields a free end for the spring, which provides the noted "float" to the spring end, and flexibility to the support surface that the spring ends define for the innerspring. Depending on where the engagement is made along the body portions of adjacent springs in the innerspring, the "float" or flexibility can be thereby adjusted.

In an embodiment of the invention, the innerspring is an array of helical coil springs arranged in orthogonal rows and columns. Each of the individual coil springs have a terminal convolution at each end thereof and a body portion made up of a number of turns therebetween. Capitalizing on a spring construction similar to that disclosed in the aforementioned U.S. Pat. No. 4,726,572, which employs laterally offset portions on the spring which are overlapped and then laced together using a small diameter cross-helical spring, the aforementioned offset portions are formed on a turn spaced inboard from the terminal convolutions of springs in the inventive assembly.

Accordingly, rather than attaching adjacent coil springs to one another at their terminal convolutions as accomplished in the prior art, the springs of the inventive innerspring are attached to each other at these offset portions at a point spaced axially inboard from the end of the spring. The manufacturing techniques for applying the cross-helicals for joining the springs remains virtually unchanged. The terminal convolutions of adjacent springs are not attached to one another, leaving one or more turns thereby free to act independently of one another in response to an applied load. As a result, the upper surface of the innerspring assembly is far more flexible and responsive to contour differences (i.e., a body lying thereon) than conventional pocketless designs in which the upper terminal convolutions are attached to one another, where the displacement of one spring in turn fairly immediately involves displacement of adjacent springs to which its terminal convolution is joined. The overall result achieved by the inventive free-end innerspring can be an improvement in comfort with all the advantages of "hard-wired" spring designs.

The foregoing features and advantages of the present invention will be further understood upon consideration of the following detailed description of certain embodiments of the present invention with reference to the accompanying drawings, in which:

DETAILED DESCRIPTION OF PRESENTLY PREFERRED EMBODIMENTS

Figure 1:
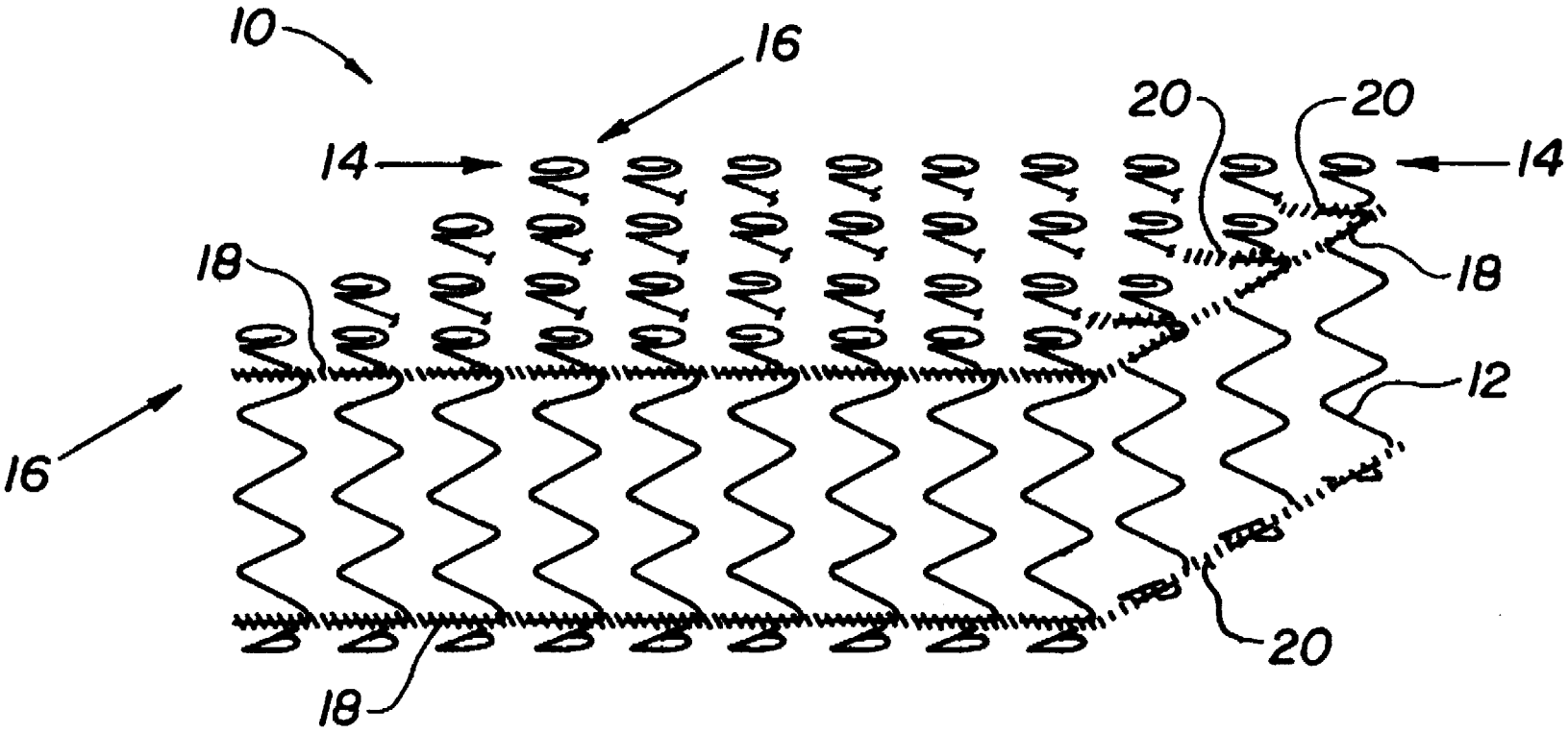
FIG. 1 is a schematic pictorial view of an innerspring assembly made in accordance with the present invention.

As shown in FIG. 1, an inventive innerspring assembly, generally indicated at 10, comprises a plurality of coil springs 12 (also referred to as "spring coils" or simply "springs") arranged side-by-side in rows 14 and columns 16 to thereby form an innerspring assembly generally rectangular in shape. The foregoing would represent a typical mattress innerspring, for example. While the embodiments discussed hereafter will generally relate to such a mattress innerspring, it will nonetheless be understood that the invention has application in other environments and other innerspring assemblies, such as furniture cushions and the like. Also, the reference to "rows" and "columns" herein is not meant to be limiting, since the terms could be used interchangeably depending on the point of reference taken.

To hold the springs 12 in place and make an integral assembly, cross-helical springs 20 and helical border wire springs 18 are coiled around convolutions of the individual spring coils, as described more particularly below. The cross-helical and helical attachments remain conventional, however, which is an advantage of the present invention.

Figure 2:
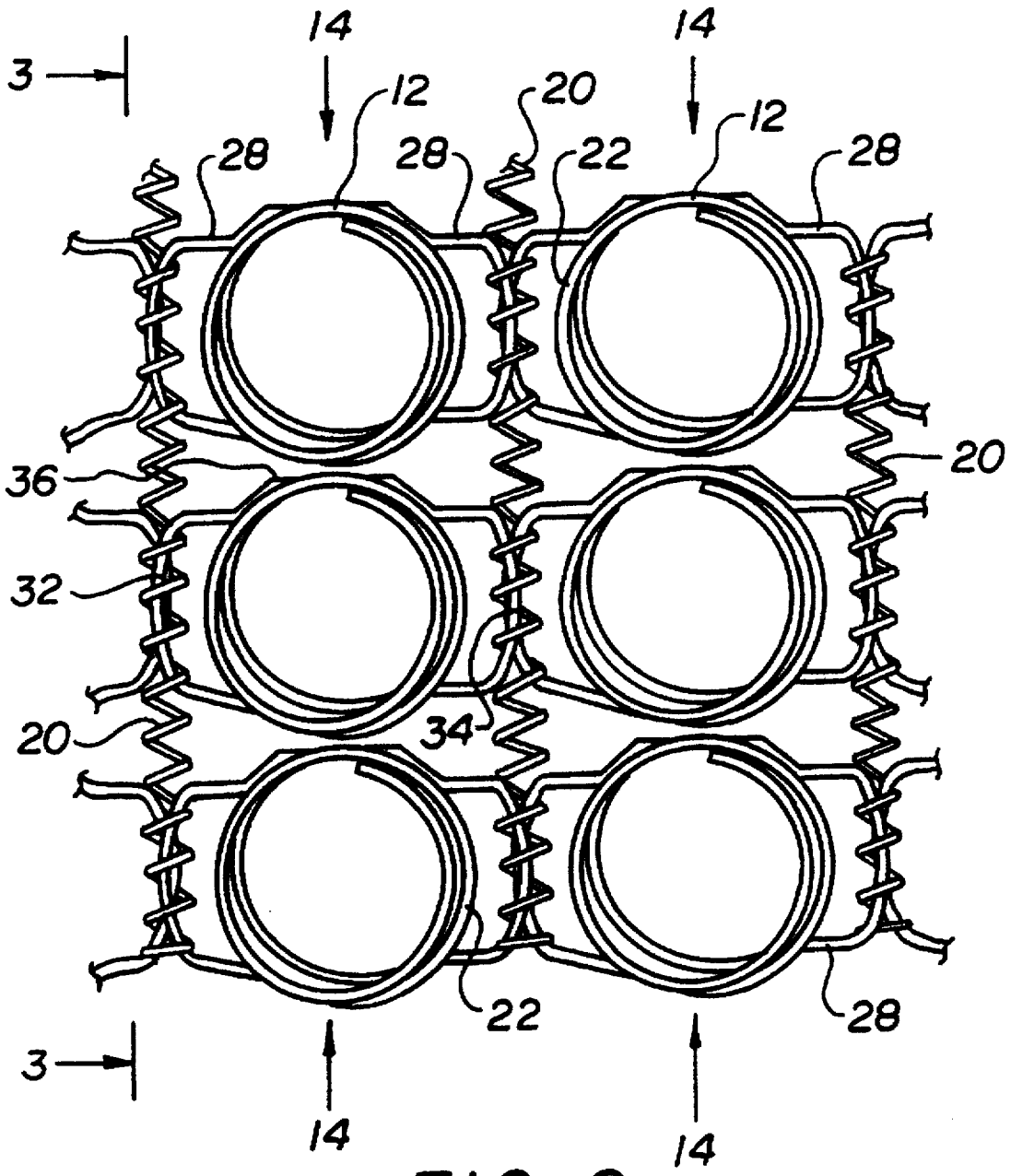
FIG. 2 is a plan view of a section of an innerspring assembly such as shown in FIG. 1 illustrating the attachment of a number of spring coils located in the interior of the inventive innerspring assembly.
Figure 3:
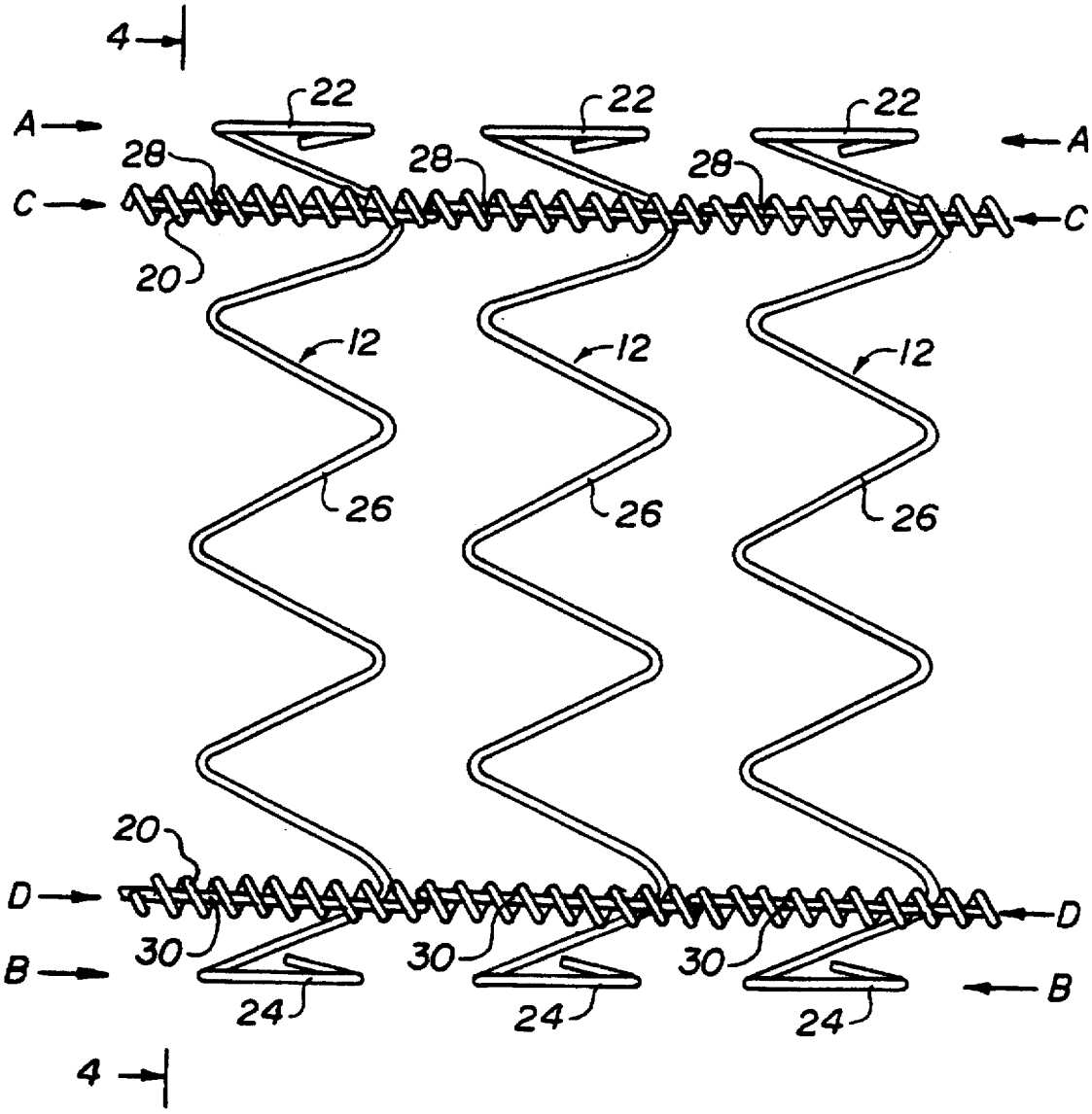
FIG. 3 is an elevational view taken along line 3—3 of FIG. 2.
Figure 4:
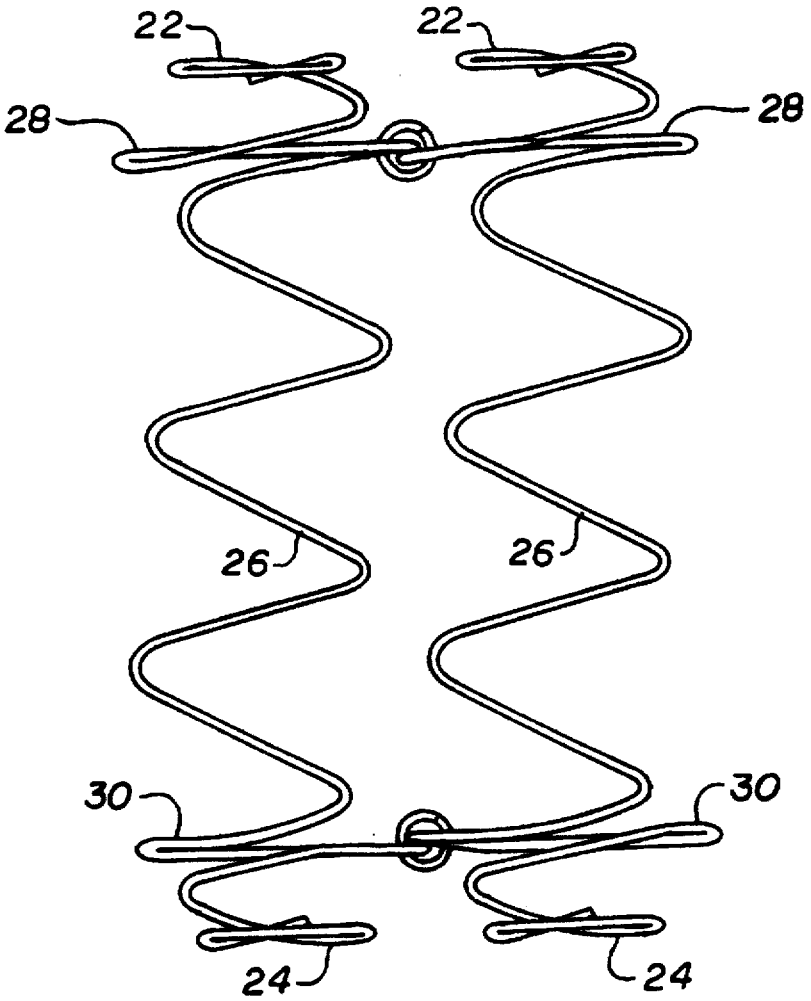
FIG. 4 is another elevational view taken along line 4—4 of FIG. 3 showing two adjacent springs joined together.

As illustrated in FIGS. 3 and 4, for example, each coil spring 12 is composed of a single, continuous piece of wire stock which is generally helical in configuration and includes an upper terminal convolution or portion 22, a lower terminal convolution or portion 24, and a body portion made up of a number of turns 26 of the wire stock. With particular reference to FIGS. 2 and 4, an attachment convolution 28, 30 for attaching adjacent coils to one another is formed on one of the turns of body portion inboard of a respective terminal convolution 22, 24. The springs 12 are arranged so that portions of the attachment convolutions 28 of adjacent coils overlap one another; it is these overlapping segments which are secured together by means of the cross-helical springs 20.

In the embodiments shown, upper terminal portion 22 is composed of a convolution of the helical coil which is substantially in the same plane AA. Likewise, the lower terminal portion or convolution 24 has the same shape as the other end of the spring 12, and is similarly disposed in plane BB. When organized into a support surface, these terminal convolutions 22, 24 will occupy a common respective plane AA, BB.

Upper attachment convolutions 28 and lower attachment convolutions 30 are provided for allowing attachment of adjacent coils to one another. These attachment convolutions are also relatively flattened so that a major portion of the turn is in a respective common plane: CC in the case of upper attachment convolution 28 and plane DD in the case of lower attachment convolution 30.

Figure 5:
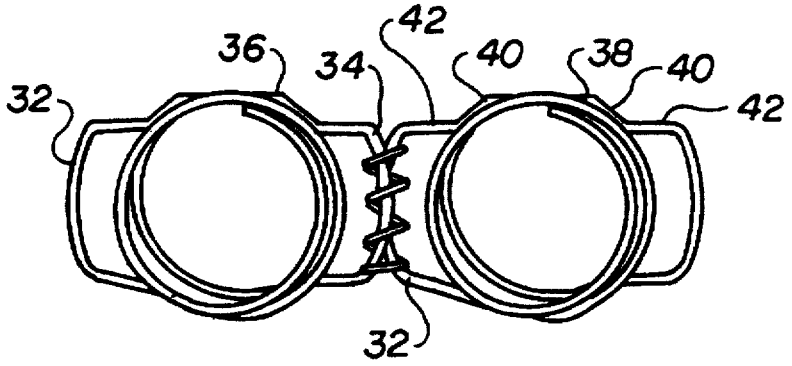
FIG. 5 is a view similar to FIG. 2 illustrating specific features of one set of overlapped offset portions of the attachment convolutions in accordance with a preferred embodiment of the invention.

Preferably, upper attachment convolutions 28 and lower attachment convolutions 30 have essentially the same shape as the terminal coils described in commonly-assigned patent U.S. Pat. No. 4,726,572, the disclosure of which is incorporated herein by reference. In essence, the terminal convolution described in that patent is moved inboard to a body turn of the inventive spring herein. As set forth in the foregoing '572 patent, an adjustable spring rate is provided through the use of a gradient arm formed with the terminal convolution. Carrying that same feature over into the instant application, and as best illustrated in FIGS. 2 and 3 for example, it will be appreciated that the free terminal convolution portions 22 and 24 have a second and different spring rate from that of the body portion (turns 26 and attachment convolutions 28, 30. There is accordingly a transition between these spring rates at the planes C—C and D—D. As "softer" free end turn(s) 22 are compressed onto the respective plane, the "firmer" body portion then dominates. It will further be noted, as again shown in FIGS. 2 and 3 for example, that the turn(s) 22 do not pass through the foregoing respective planes, but instead collapse upon the same when compressed. As illustrated in FIG. 5, these attachment convolutions are somewhat rectangular in shape, with first offset portions 32, second offset portions 34 and third offset portions 36 which are spaced radially (laterally) outwardly from the spring coil axis and from a cylindrical shape generally defined by the circular coils of the body portion. The third offset portions 36 of the springs, or at least those of the springs located on the periphery of the array, each have a stepped segment comprising a substantially straight major part 38 extending generally perpendicular to the first and second offset portions, and short parts 40 extending from the ends of the straight part to the remaining portions 42 of the third offset portions 36. Attachment convolutions of this structure are advantageously employed, for example, in securing the coils located on the periphery of the array to a border wire to prevent rotation of the third offset portion relative to the border wire, as described in the above noted U.S. Pat. No. 4,726,572.

Adjacent spring coils, as illustrated in FIG. 2 through 4, are attached to one another by means of cross-helical springs 20 used to join the overlapped attachment convolution portions together. While overlapped segments are preferred, obviously spacing the attachment segments 32, 34 of adjacent springs closely together and joining them with the cross-helical springs 20 would also work, but is considered less desirable.

Figure 6:
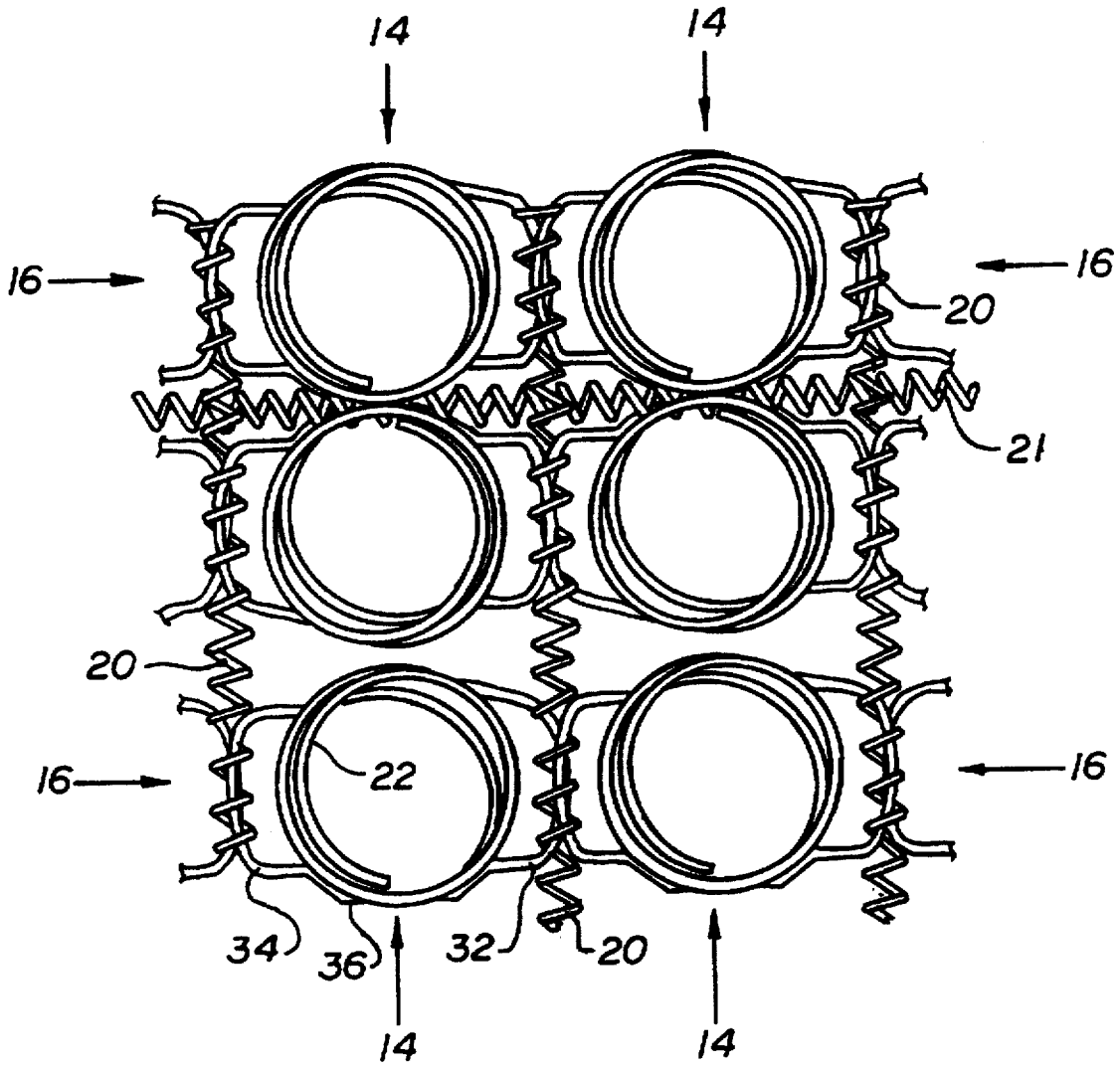
FIG. 6 is a view similar to FIG. 2 illustrating another embodiment of the invention in which coil springs are arranged in mirror-image relation and secured together along transverse directions.
Figure 7:
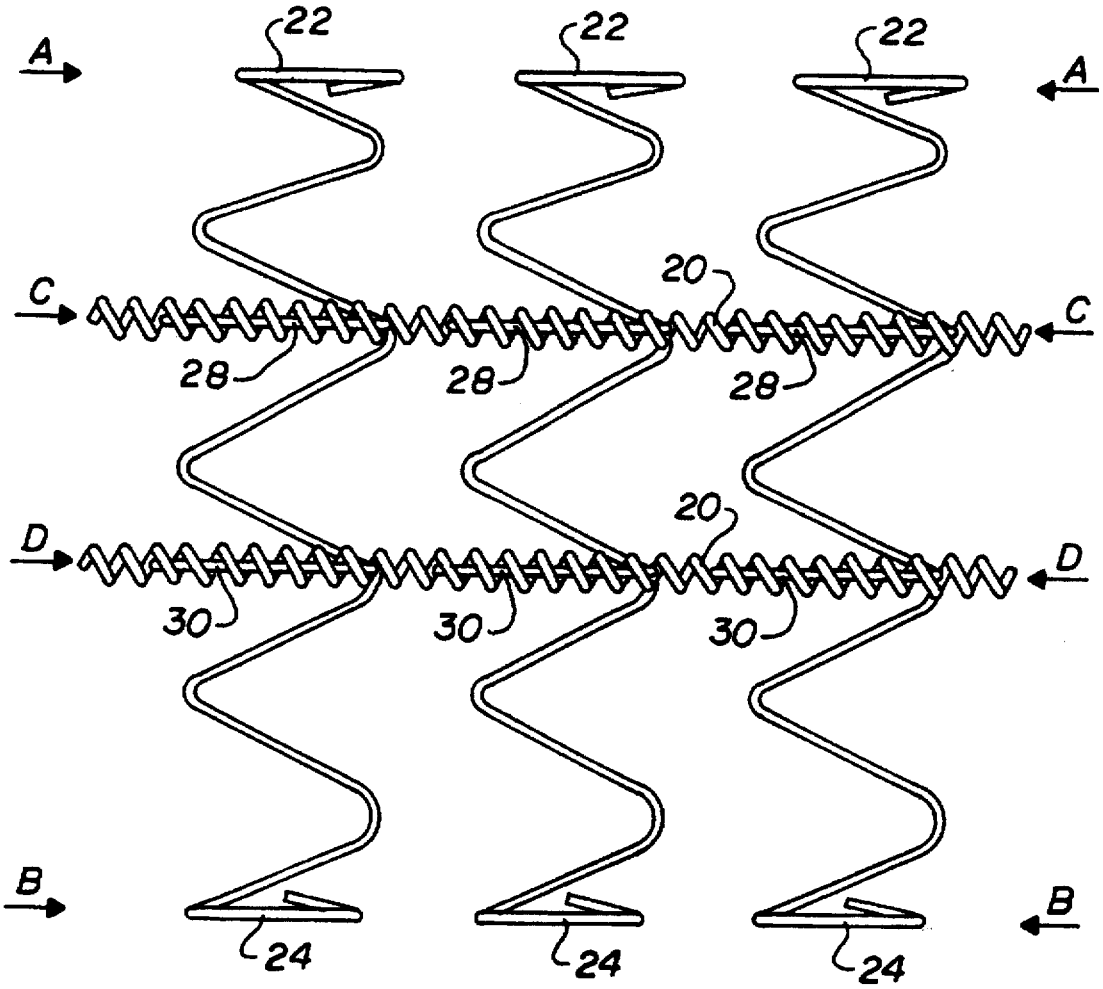
FIG. 7 is an elevantional view similar to FIG. 3 illustrating another embodiment of the invention in which the attachment comprise the second coil turns inboard from a terminal convolution.

Since the terminal convolution 22 and 24 turn outboard of the attachment are left free, when an external pressure or force is applied thereto, these free ends can readily move off-axis of their respective spring (i.e., shift sideways) and independently of any other spring. However, as shown in FIGS. 2, 5 and 6, at least a portion or segment of the terminal convolutions, 22 or 24, overlap the third offset portion 36 and short parts 40 of the attachment convolutions, 28 or 30, so that when a terminal convolution is compressed along the longitudinal axis of the spring on to the attachment convolution/the terminal convolution contacts the attachment convolution and is limited from passing through the plane in which the attachment convolution lies. When the terminal convolution is compressed into contact with the offset portion of the attachment convolution, the performance of the spring is dictated by the spring body portion. When the terminal convolution is not in contact with the offset portion of the attachment convolution, the spring performance is dictated by the terminal convolution and the body portion of the spring. As a result, the inventive innerspring assembly is more flexible in use, since action on one spring terminal convolution is not necessarily directly translated to an adjacent spring. It is considered that the surface of an innerspring having such "free" spring ends will adjust itself much more readily to diverse contours applied to the surface of the innerspring. The overall result can be greater comfort to the user. Moreover, since encasement fabrics are not involved as in pocketed springs, the mattress is considered to be more stable, long term, and is easier to manufacture than mattresses employing a pocketed spring design, since conventional manufacturing techniques using clips and cross-helicals are employed.

In accordance with still another feature of the invention, the flexibility of an innerspring assembly embodying the present invention—in other words the degree to which the upper portions or convolutions 22 of adjacent springs are free to move independently of one another—can be adjusted by varying the relative distance between planes AA and CC, between planes CC and DD, and between planes DD and BB, either individually or in combination. Thus, for example, increasing the distance between planes AA and CC is considered to result in more flexibility of upper convolutions 22 relative to one another. Adjustment of the distances between the different planes, and locating the interconnection planes with one, two or even more turns outboard from the same, yields a spring assembly which can be made having a desired degree of flexibility from a broad range of possible choices.

The innerspring assembly of the present invention can be used to make innerspring mattresses of any type. As well appreciated in the art, innerspring mattresses are typically made by covering at least the upper surface of the innerspring, defined by the upper terminal convolutions or portions of the coils, with insulators, flexible padding made from a flexible fabric or foam, ticking and the like.

In the embodiment depicted in FIG. 6, springs in the interior of the array are provided with attachment convolutions having the generally rectangular shape illustrated in U.S. Pat. No. 4,726,572. This shape with the third offset allows adjacent interior coils to be secured together in pairs by helical springs 21 in a transverse direction (i.e., in the direction of columns 16 of FIG. 1) in addition to longitudinally in the direction of rows 14. This can be done as shown in FIG. 6 by arranging adjacent springs in a row 14 in pairs, with the coils in each pair in mirror-image relation with one another so that the third offset portions 36 of the attachment convolutions of each spring pair overlap one another.

Accordingly, while some embodiments of the present invention have been illustrated above, it should be appreciated that many modifications can be made without departing from the spirit and scope of the invention. For example, although the above illustrates cross-helical springs being used for attaching adjacent coils together, any attachment means can be used. For example, clips as illustrated in the above noted Bell patent can be employed. Also, the terminal portions 22 and 24 of the springs need not be helical or circular in configuration, but can be any configuration which will form a suitable support surface.

Furthermore, the individual springs 12 can be made from multiple pieces rather than a single, continuous piece of wire as shown in the illustrated embodiments. Also, the attachment convolutions can have any shape, and in fact need not be convolutions at all, it being sufficient that the body portion of the springs define a structure allowing adjacent springs to be attached to one another at their body portions with the terminal portions being free to move with respect to one another.

Finally, it is also within the scope of the invention that some terminal portions of springs in the innerspring could be loosely interconnected one to another, as by various engagements of the same to an insulator applied over the innerspring surface. Such an engagement would not defeat the free movement of the remainder of the terminal portions with respect to one another. So long as the majority of the terminal portions of the springs are free to move independently of one another in the axial direction, i.e., in the direction of the respective axes of the spring helixes, the advantages of the invention should be realized. All such modifications are intended to be included within the scope of the present invention.

We claim:

1. A mattress innerspring assembly comprising:

a plurality of springs organized into an array and defining a support surface to said innerspring assembly, means for interconnecting said springs into said array, each said spring being made in a continuous piece having a compressible, generally helical body portion, a compressible terminal convolution at an end of said body portion, first and second offset segments located on an end of said body portion and offset radially outside of said generally helical body portion and spaced from said terminal convolution, said first and second offset segments adapted for engagement with said means for interconnecting said springs, such that said terminal convolution remains free of said interconnecting means when said spring is in said innerspring assembly, and a substantially straight third segment connecting said first and second offset segments on said body portion which said terminal convolution overlaps and contacts when compressed along the longitudinal axis of the spring onto said body portion.

2. An innerspring comprising:

a plurality of helical springs each formed of a plurality of coil turns, said springs being organized into an array and defining a support surface to said innerspring, means for interconnecting said springs into said array, each said spring being made in a continuous piece having a terminal convolution at each end of a generally helical body portion of said coil turns, and first and second offset segments formed on opposite sides of an attachment convolution at each end of said body portion and spaced from a respective terminal convolution which extends from each attachment convolution, said first and second offset segments having generally straight portions which are laterally outboard from a cylindrical shape generally defined by the coil turns of said body portion, said first and second offset segments being located in substantially the same plane which is generally perpendicular to a longitudinal axis of said body portion, a generally straight third offset segment between said first and second offset segments and generally tangential to said body portion, said terminal convolution having a radial extent from the longitudinal axis of said body portion such that a portion of the terminal convolution overlaps and contacts the third offset segment when the terminal convolution is compressed relative to said portion along a longitudinal axis of said body portion.

3. The innerspring of claim 2 wherein each said coil turn having said offset segment thereon is the first turn inboard from a respective terminal convolution.

4. The innerspring of claim 2 wherein each said coil turn having said offset segments formed thereon is the second turn inboard from a respective terminal convolution, said terminal convolution and a first turn inboard from said terminal convolution being thereby free of said interconnecting means.

5. A mattress innerspring comprising:

a plurality of helical springs each formed of a plurality of coil turns, said springs being organized into an array of orthogonal rows and columns and defining support surfaces to said innerspring on top and bottom sides thereof, means for connecting adjacent springs one to another in said array, each said spring having an attachment convolution and a terminal convolution at each end of a generally cylindrical body portion, with first and second offset segments in each attachment convolution at each end of said body portion and spaced from a respective terminal convolution, said offset segments being on opposite sides of said body portion and having generally straight portions which are laterally outboard from the generally cylindrical shape of said body portion, said first and second offset segments connected by a generally straight third offset segment which overlaps a turn of said body portion, said offset segments being located in substantially the same plane which is normal to a longitudinal axis of said cylindrical shape, said first and second offset segments being closely adjacent in pairs in the array and adapted for engagement with said means for interconnecting said springs in the innerspring, such that each said respective terminal convolution remains free of said interconnecting means when said spring is in the innerspring assembly, and said terminal convolution has a diameter of at least as wide as a diameter of said coil turns of said body portion such that said terminal convolution overlaps and contacts said third offset segment of a respective coil when compressed on to said body portion along the longitudinal axis of the coil.

6. The innerspring of claim 5 wherein said springs each further include a third offset segment which is generally perpendicular to said other two offset segments, with said springs being further located in said array such that said third offset segments of springs in adjacent columns are parallel and close together in said array with a second cross-helical spring surrounding and joining said close together third offset segments along said columns.

7. The innerspring of claim 5 wherein said interconnecting means is a cross-helical spring, and wherein said springs are located in said array such that offset segments of springs in adjacent rows are parallel and close together in said array with said cross-helical spring surrounding and joining said close together offset segments along said rows.

8. The innerspring of claim 7 wherein said offset segments of adjacent springs are overlapped.

9. A mattress innerspring comprising:

a plurality of helical springs organized into an array of orthogonal rows and columns, each said spring being formed from a plurality of coil turns defining a generally helical compressible body portion and a terminal convolution at an end of said body portion, said body portion including an attachment convolution adapted for engagement with means for interconnecting a plurality of said springs in said innerspring assembly, said attachment convolution being spaced from said terminal convolution such that said terminal convolution remains free of said interconnecting means, said attachment convolution having first and second offset portions located on opposite sides of said attachment convolution and laterally outboard from a cylindrical shape defined by the coil turns of said body portion, and a generally straight third offset portion connecting the first and second offset portions, at least a portion of said terminal convolution axially aligned with said third offset portion of said attachment convolution such that said terminal convolution overlaps and contacts said third offset portion of said attachment convolution when said terminal convolution is fully compressed upon said attachment convolution along a longitudinal axis of the innerspring, and means for interconnecting a plurality of said springs in said innerspring assembly, said interconnecting means adapted to connect the first and second offset portions of said attachment convolutions of adjacent springs in the array.

10. The mattress innerspring of claim 9 wherein said interconnecting means comprising cross-helical springs.

11. A spring for use in a mattress innerspring assembly having an array of interconnected springs, the spring comprising:

a body portion having a plurality of generally helical turns about a longitudinal axis of the spring, an attachment convolution extending from the body portion at an axial end of the body portion, the attachment convolution having first and second offset portions which are located radially outside of a generally cylindrical shape defined by the helical turns of the body portion, and a generally straight third offset portion which connects the first and second offset portions and which is axially aligned with a segment of a generally helical terminal convolution extending from the attachment convolution along the longitudinal axis of the spring and away from the body portion and attachment convolution, the terminal convolution thus having a segment which overlaps an offset portion of the attachment convolution, whereby as the terminal convolution is compressed along the longitudinal axis of the coil the terminal convolution contacts the third offset portion of the attachment convolution.

12. The spring of claim 11 having an attachment convolution and terminal convolution at both ends of the spring body portion.

13. The spring of claim 11 wherein the attachment convolution has at least two offset portions, with one offset portion configured for attachment to an offset portion of an adjacent spring in an innerspring assembly, and another offset portion positioned for contact with the terminal convolution when the terminal convolution is compressed along the longitudinal axis of the spring.

14. The spring of claim 13 wherein the offset portion configured for attachment to an offset portion of an adjacent spring extends radially beyond the body portion.

* * * * *